US007868831B2

(12) United States Patent
Hung et al.

(10) Patent No.: US 7,868,831 B2
(45) Date of Patent: Jan. 11, 2011

(54) COMPLEX ANTENNA

(75) Inventors: Chen-Ta Hung, Tu-cheng (TW); Lung-Sheng Tai, Tu-cheng (TW); Wen-Fong Su, Tu-cheng (TW)

(73) Assignee: Hon Hai Precision Ind. Co., Ltd., Taipei Hsien (TW)

( * ) Notice: Subject to any disclaimer, the term of this patent is extended or adjusted under 35 U.S.C. 154(b) by 378 days.

(21) Appl. No.: 12/150,382

(22) Filed: Apr. 28, 2008

(65) Prior Publication Data

US 2008/0266185 A1 Oct. 30, 2008

(30) Foreign Application Priority Data

Apr. 27, 2007 (CN) ..... 2007 1 0022050

(51) Int. Cl.
*H01Q 1/38* (2006.01)

(52) U.S. Cl. ..... 343/700 MS; 343/702; 343/846

(58) Field of Classification Search ..... 343/700 MS, 343/702, 846
See application file for complete search history.

(56) References Cited

U.S. PATENT DOCUMENTS

| | | | | |
|---|---|---|---|---|
| 7,450,076 | B1 * | 11/2008 | Lin et al. | 343/702 |
| 7,633,448 | B2 * | 12/2009 | Su et al. | 343/702 |
| 7,746,288 | B2 * | 6/2010 | Wang et al. | 343/846 |
| 2006/0262016 | A1 | 11/2006 | Hung | |
| 2008/0007461 | A1 * | 1/2008 | Su et al. | 343/700 MS |

* cited by examiner

*Primary Examiner*—Douglas W Owens
*Assistant Examiner*—Chuc D Tran
(74) *Attorney, Agent, or Firm*—Wei Te Chung; Andrew C. Cheng; Ming Chieh Chang

(57) ABSTRACT

A complex antenna includes a first antenna and a second antenna having a grounding element and an installing element sharing with the first antenna. The first antenna working in a WLAN (Wireless Local Area Network) comprises a first connecting element, a first radiating element and a second radiating element extending from the first connecting element in opposite direction. The second antenna working in a WWAN (Wireless Wide Area Network) comprises a second connecting element and at least three radiating elements extending from the second connecting element in different directions.

20 Claims, 9 Drawing Sheets

COMPLEX ANTENNA

BACKGROUND OF THE INVENTION

1. Field of the Invention

The present invention relates generally to an antenna, and more particularly to a complex antenna working in two wireless networks.

2. Description of Prior Art

Wireless communication devices, such as cellular phones, notebook computers, electronic appliances, and the like, are normally equipped with an antenna that serves as a medium for transmission and reception of electromagnetic signals, such as date, audio, image, and so on. However, more and more people dissatisfy their electronic devices only work in WLAN (Wireless Wide Area Network). Making the portable electronic devices working in WWAN (Wireless Wide Area Network) or GPS (Global Positioning System) is a purpose of the many people.

In recent years, WLAN adopts two technical standards of Bluetooth and Wi-Fi. Bluetooth works in 2.4 GHz, and Wi-Fi works in 2.4 GHz and 5 GHz. However, WWAN adopts three technical standards of GSM(Global System for Mobile Communication), GPS(Global Positioning System) and CDMA (Code Division Multiple Access). Operating frequency bands of the GSM are 900/1800 MHz, and operating frequency band of the GPS is 1.575 GHz. CDMA includes three kinds of technical standards: CDMA2000, WCDMA and TD-SCDMA. Operating frequency bands of the CDMA2000 are 800, 900, 1700, 1800, 1900, and 2100 MHz. Operating frequency bands of the WCDMA are 1800, 1900, and 2100 MHz. Operating frequency bands of the TD-SCDMA are 900, 1800, and 2100 MHz.

So, an antenna of a notebook must operate in above frequency bands, the portable electronic device is capable of working in WLAN and WWAN. At present, the portable electronic device is usually installed with two antennas for working in the WLAN and WWAN, one antenna working in the WLAN and another antenna working in the WWAN. However, with the development of the miniaturization of the portable electronic device, more and more portable electronic devices are difficult to install two sets antennas in the limited inner space.

US patent publication No. 2006/0262016A1 discloses a multi-band antenna including a WWAN antenna and a WLAN antenna. The multi-band antenna is capable to work in WWAN and WLAN at the same time.

However, the multi-band antenna has narrow frequency band, and is not capable to cover all frequency bands of WWAN. In addition, the WLAN antenna and the WWAN antenna extending from common edge of a grounding element influence radiating performance of the antenna.

Hence, in this art, a complex antenna to overcome the above-mentioned disadvantages of the prior art will be described in detail in the following embodiment.

SUMMARY OF THE INVENTION

An object of the present invention is to provide a complex antenna which has more wider frequency band, and the antenna having the excellent performance. To achieve the aforementioned object, the present invention provides a complex antenna comprising a grounding element, a first antenna, and a second antenna. The grounding element has two longitudinal sides. The first antenna operates in a first wireless network comprising a first radiating body spaced apart from the grounding element and a first connecting element connecting the first radiating body and the grounding element. The second antenna operates in a second wireless network comprising a second body spaced apart from the grounding element and a second connecting element connecting the second radiating body and the grounding element. The first antenna extends from an edge of the grounding element. The first radiating body comprises a first radiating element and a second radiating element. The second antenna extends from another edge of the grounding element. The second radiating body comprises a third radiating element extending from a terminal of the connecting element, a fourth radiating element, and a fifth radiating element extending from a middle portion of the connecting element.

Additional novel features and advantages of the present invention will become apparent by reference to the following detailed description when taken in conjunction with the accompanying drawings.

DETAILED DESCRIPTION OF THE INVENTION

Reference will now be made in detail to the preferred embodiment of the present invention.

Figure 1:
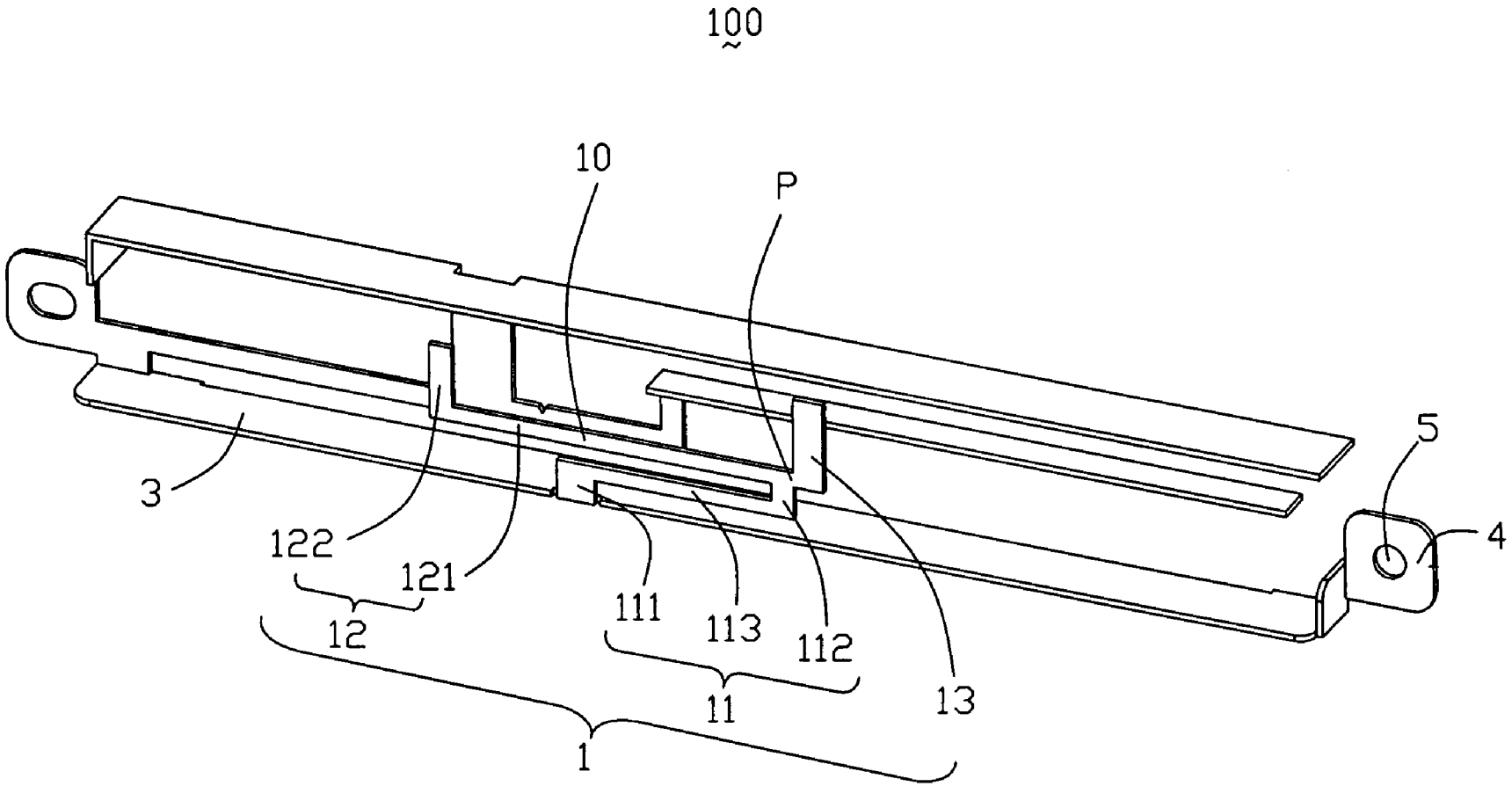
FIG. 1 is a perspective view of a complex antenna in accordance with a first embodiment of the present invention.
Figure 2:
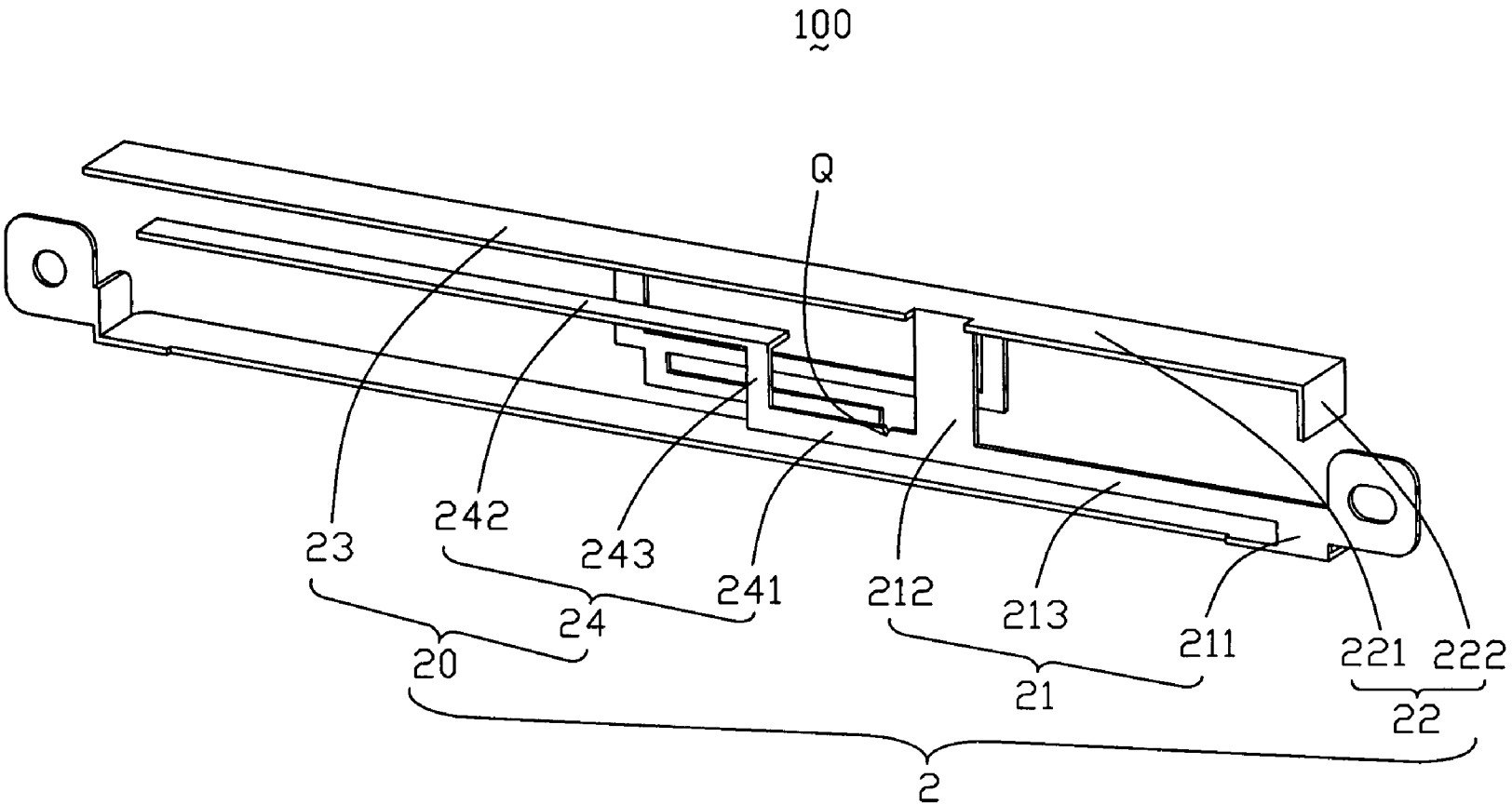
FIG. 2 is a view similar to FIG. 1, but from a different aspect.

Referring to FIGS. 1 and 2, a complex antenna 100 in accordance with a first embodiment of the present invention comprises a grounding element 3 lying in a horizontal plane and having two longitudinal sides, two installing elements 4 locating respectively at two ends of the grounding element 3, a first antenna 1 and a second antenna 2 extending respectively from two sides of the grounding element 3. The grounding element 3 has a top surface and a bottom surface. All of the first antenna 1, the second antenna 2, and the installing elements 4 locate upside of the top surface of the grounding element 3.

The first antenna 1 operating in WLAN extends upwardly from middle portion of a first side of the grounding element 3. The first antenna 1 comprises a first radiating body 10 spaced apart from the grounding element 3, a first connecting element 11 in a vertical plane connecting the grounding element 3. The first connecting element 11 comprises a first branch 111 connecting to the grounding element 3, a second branch 112 connecting to a point P of the first radiating body 10, and a third branch 113 connecting the first branch 111 and the second branch 112. The first radiating body 10 comprises a first radiating element 12 working in 2.4 GHz frequency band and a second radiating element 13 working in 5 GHz frequency band. The joint point P of the first connecting element 11 and the first radiating body 10 also is a dividing portion of the first radiating element 12 and the second radiating element 13. A first feeding line (not shown) comprises an inner conductor electrically connecting to the point P and an outer conductor electrically connecting to the grounding element 3. The first radiating element 12 has L-shape and comprises a first radiating arm 121 extending from the point P along a horizontal direction and a second radiating arm 122 extending vertically from an end of the first radiating arm 121. The second radiating element 13 extends vertically from the point P parallel to the second radiating arm 122.

The second antenna 2 operating in WWAN extends upwardly from a portion of a second side of the grounding element 3 adjacent to the installing element 4. The second antenna 2 comprises a second radiating body 20 spaced apart from the grounding element 3 and a second connecting element 21 parallel to the first connecting element 11 and connecting the second radiating body 20 and the grounding element 3. The second connecting element 21 comprises a first part 211 extending vertically from the portion of the grounding element 3, a vertically extending second part 212 connecting to the second radiating body 20, and a horizontal third part 213 connecting the first part 211 and the second part 212. The second radiating body 20 comprises a third radiating element 22 extending from an end of the second connecting element 21, a fourth radiating element 23, and a fifth radiating element 24 extending from a joint of the second part 212 and the third part 213. The third radiating element 22 operates in 1800 MHz frequency band and comprises a third radiating arm 221 parallel to the grounding element 3 and a fourth radiating arm 222 extending vertically from an end of the third radiating arm 221 toward the grounding element 3. The fourth radiating element 23 operates in 900 MHz frequency band and extends from the other end of the third radiating arm 221 opposite to the fourth radiating arm 222. The fourth radiating element 23 and the third radiating arm 221 locate in the same plane and parallel to the grounding element 3. The second connecting element 21 connects to the joint of the fourth radiating element 23 and the third radiating arm 221. The second connecting element 21 is perpendicular to the third radiating element 22 and the third radiating arm 221. The fifth radiating element 24 is Z-shape and extends from a joint of the second part 212 and the third part 213 of the second connecting element 21. The fifth radiating element 24 comprises a horizontal fifth radiating arm 241 located in a vertical plane and extending from the joint of the second part 212 and the third part 213 of the second connecting element 21, a sixth radiating arm 242 spaced apart from the fifth radiating arm 241 and parallel to the grounding element 3, and a seventh radiating arm 243 connecting the fifth radiating arm 241 and the sixth radiating arm 242. The length of the fifth radiating element 24 is close to the third radiating element 23. The fifth radiating element 24 can enhance high frequency band of WWAN for achieving wider frequency band. A feeding point Q locates at a position in the fifth radiating arm 241 spacing an appropriate distance from the joint of the second part 212 and the third part 213. A second feeding line (not shown) comprises an inner conductor electrically connecting to the point Q and an outer conductor electrically connecting to the grounding element 3.

The installing elements 4 are positioned respectively at two longitudinal ends of the grounding element 3. Each installing element 4 has a hole for a screw drilling through to fix the complex antenna 100 in the notebook or other electronic device.

Figure 9:
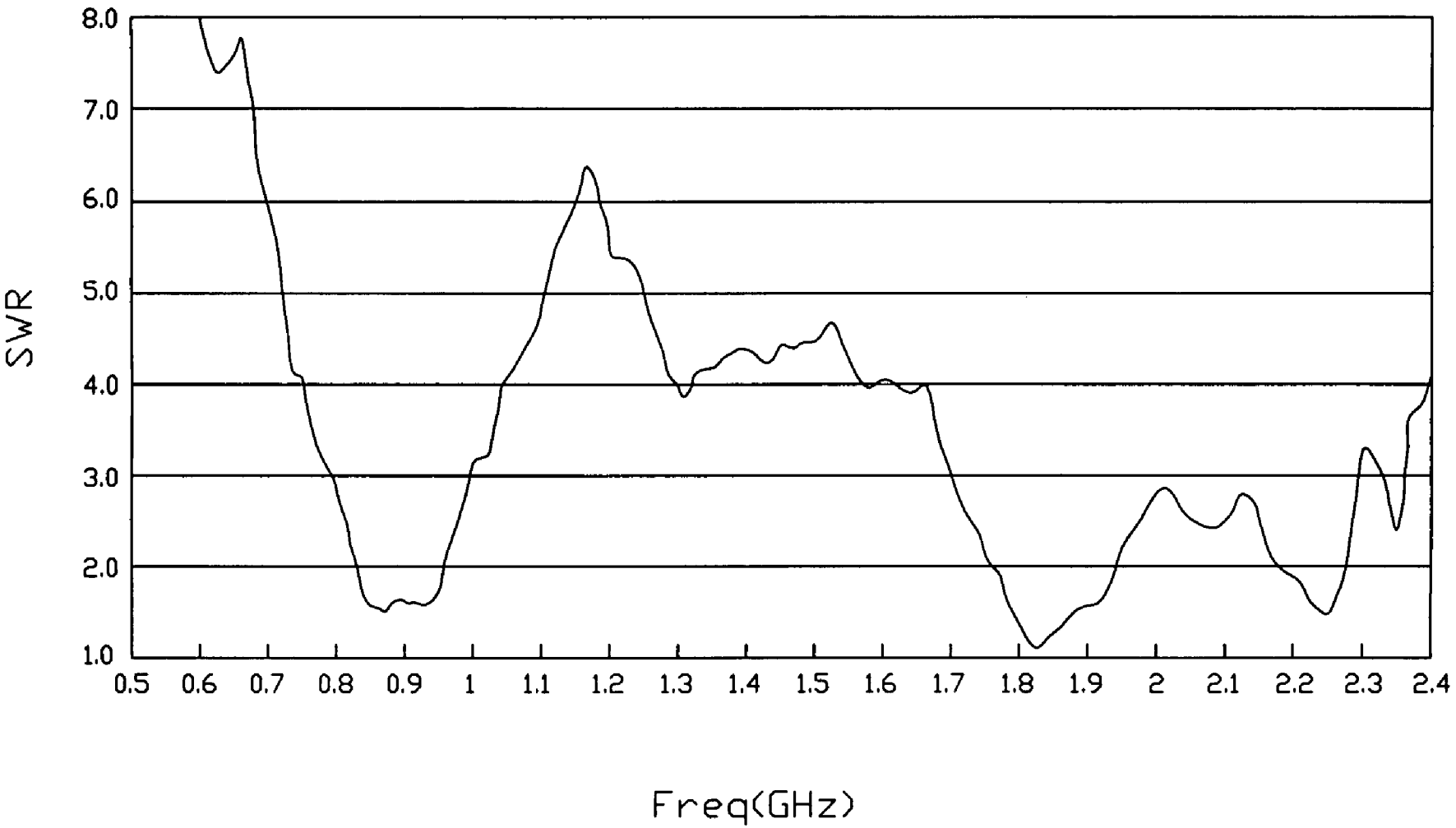
FIG. 9 is a test chart recording for the complex antenna of FIG. 1, showing Voltage Standing Wave Ratio (VSWR) as a function of WWAN frequency.

FIG. 9 is a test chart of Voltage Standing Wave Ratio of the second antenna 2 of the complex antenna 100. Generally speaking, VSWR under 2 dB is considered as having good receiving quality. Referring to FIG. 9, operating frequency band of the second antenna 2 are 780 MHz-1000 MHz and 1.7 GHz-2.3 GHz. Above-mentioned operating frequency band has covered frequency band of the GSM, CDMA2000, WCDMA, and TD-SCDMA. Of course, the second antenna 2 also can work in 1575 MHz frequency band of the GPS when adjusting the length of the fourth radiating element 23 element and the fifth radiating element 24.

Operating frequency band of the complex antenna 100 in accordance with the first embodiment of the present invention has covered all of the frequency bands of the WWAN and WLAN. Further more, the first antenna 1 and the second antenna 2 respectively extend upwardly from opposite sides of the grounding element 3 and both locate at the same side of the grounding element 3. So, the complex antenna 100 has concentrative structure and can reduce the interference between the first antenna 1 and the second antenna 2.

Figure 3:
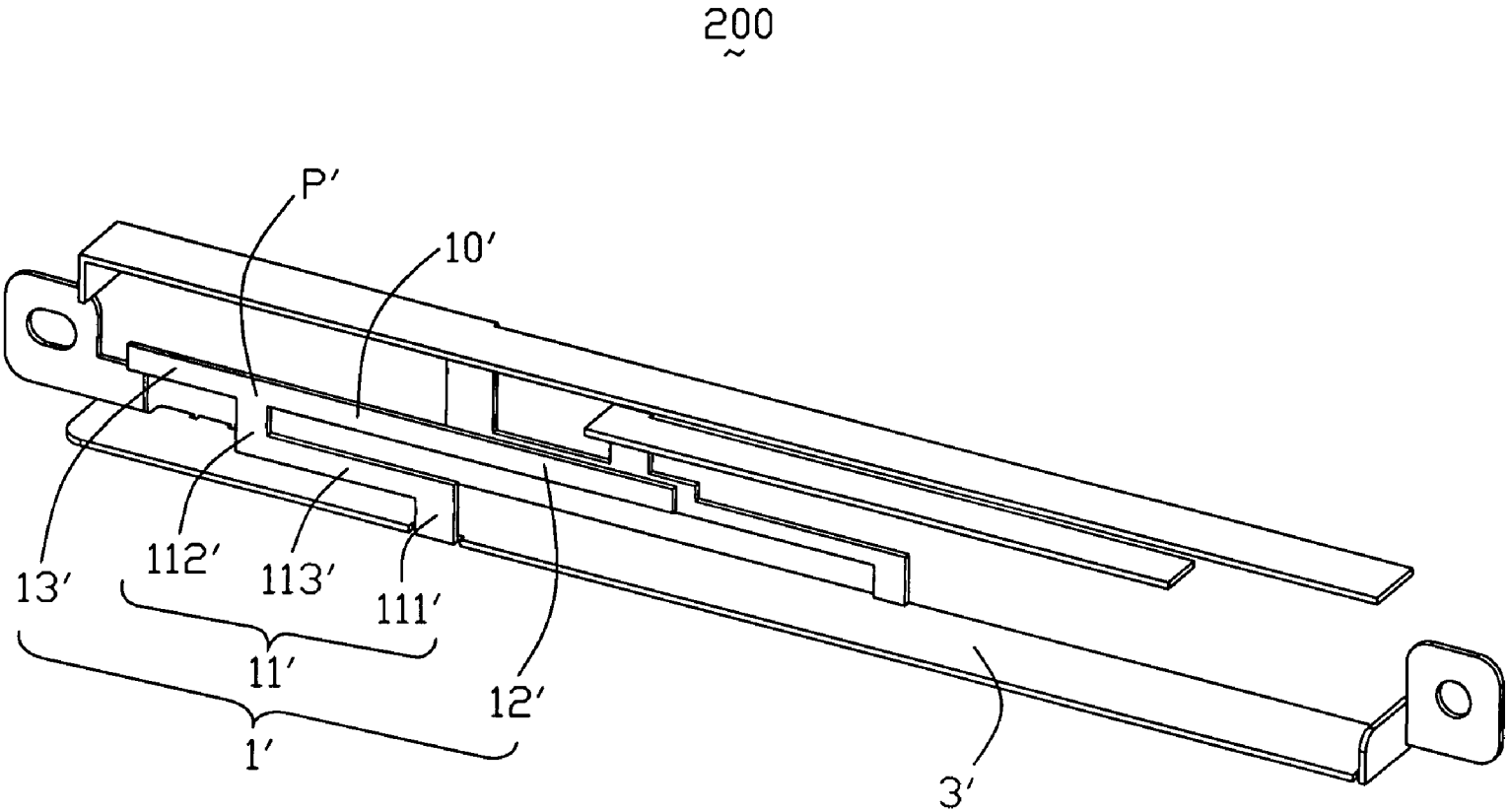
FIG. 3 is a perspective view of a complex antenna in accordance with a second embodiment of the present invention.
Figure 4:
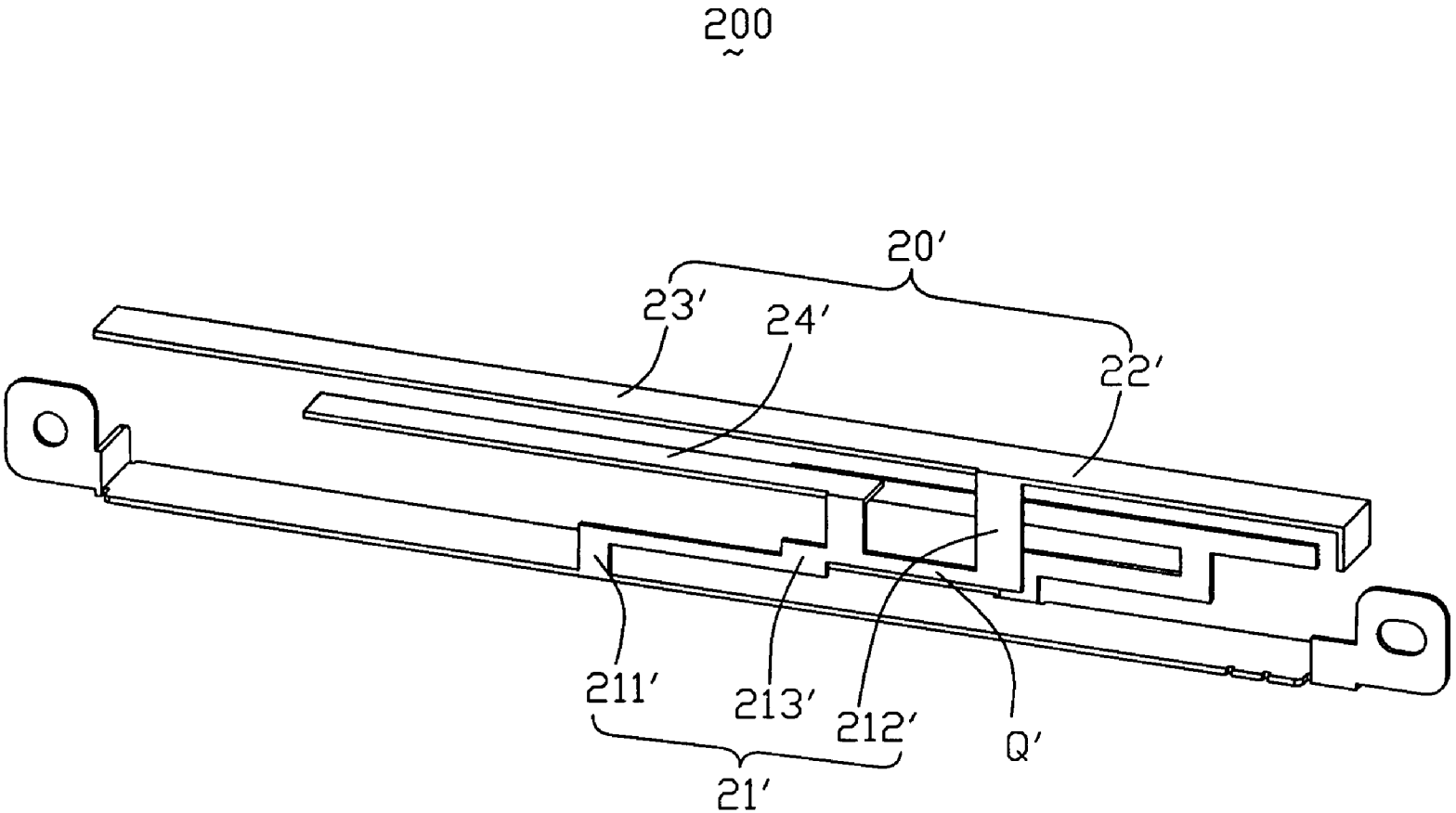
FIG. 4 is a view similar to FIG. 3, but from a different aspect.

Referring to FIG. 3 and FIG. 4, it's a complex antenna 200 in accordance with a second embodiment of the present invention. Basic structure of the complex antenna 200 is approximately same as that of the complex antenna 100. The complex antenna 200 comprises a first antenna 1' and a second antenna 2'. Description of the different between the complex antenna 200 and the complex antenna 100 is as follows.

The first antenna 1' of the complex antenna 200 extends upwardly from a side of the grounding element 3' comprising a first radiating body 10' spaced apart from a grounding element 3' and extending along a longitudinal direction and a first connecting element 11' lying in a vertical plane and connecting the first radiating body 10' and the grounding element 3'. The first radiating body 10 comprises a first radiating element 12 operating at 2.4 GHz frequency band and a second radiating element 13 operating at 5 GHz frequency band. A joint P of the first connecting element 11 and the first radiating body 10 also is a dividing point of the first radiating element 12 and the second radiating element 13. A first feeding line (not shown) comprises an inner conductor electrically connecting at the joint P and an outer conductor electrically connecting at the grounding element 3. The first radiating element 12, the second radiating element 13, and the first connecting element 11 are in a perpendicular plane.

The second antenna 2' of the Complex antenna 200 working in WWAN extends upwardly from another side of the grounding element 3'. The second antenna 2' comprises a second radiating body 20' spaced apart from the grounding element 3' and a second connecting element 21' lying in a vertical plane and connecting the radiating body 20' and the grounding element 3'. The second connecting element 21' comprises a first part 211' extending upwardly and perpendicularly from the side of the grounding element 3' and a second part 212' spaced apart from the first part 211', and an inverted Z-shaped third part 213' connecting the first part 211' and the second part 212'. The second radiating body 20' comprises a third radiating element 22' operating at 1800 MHz frequency band, a fourth radiating element 23' operating at 900 MHz, and an L-shaped fifth radiating element 24'. One terminal end of the second connecting element 21' connects at a joint of the third radiating element 22' and the fourth radiating element 23', and the other terminal end of the second connecting element 21' connects at a middle portion of the side of the grounding element 3'. The fifth radiating element 24' extends from the third part 213' of the second connecting element 21'. A length of the fifth radiating element 24' is about equal to the fourth radiating element 23'. So, the fifth radiating element 24' can widen the high frequency band of WWAN. A feeding point Q locates at the third part 213'. A second feeding line (not shown) comprises an inner conductor electrically connecting at the feeding point Q' and an outer conductor electrically connecting at the grounding element.

Figure 5:
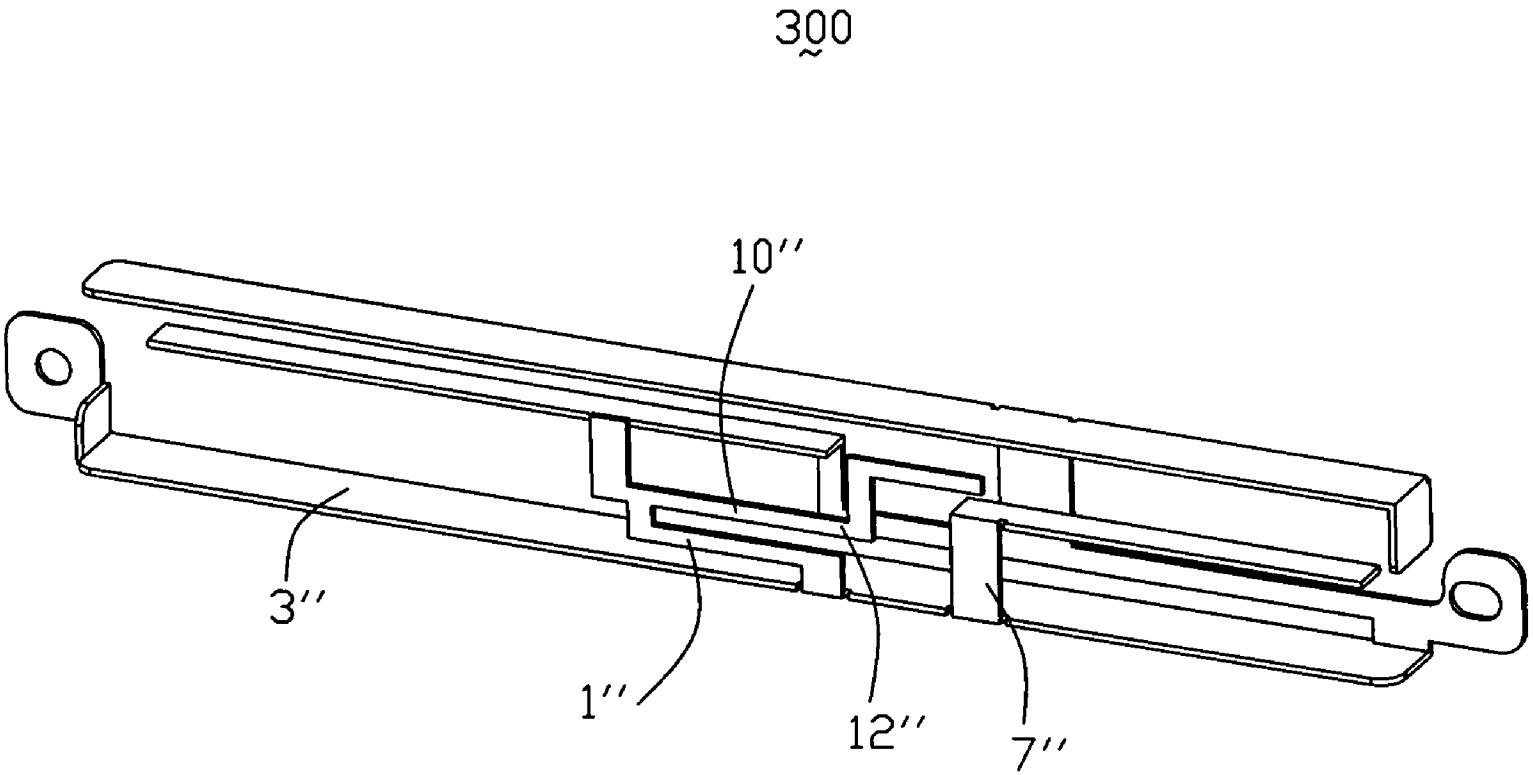
FIG. 5 is a perspective view of a complex antenna in accordance with a third embodiment of the present invention.
Figure 6:
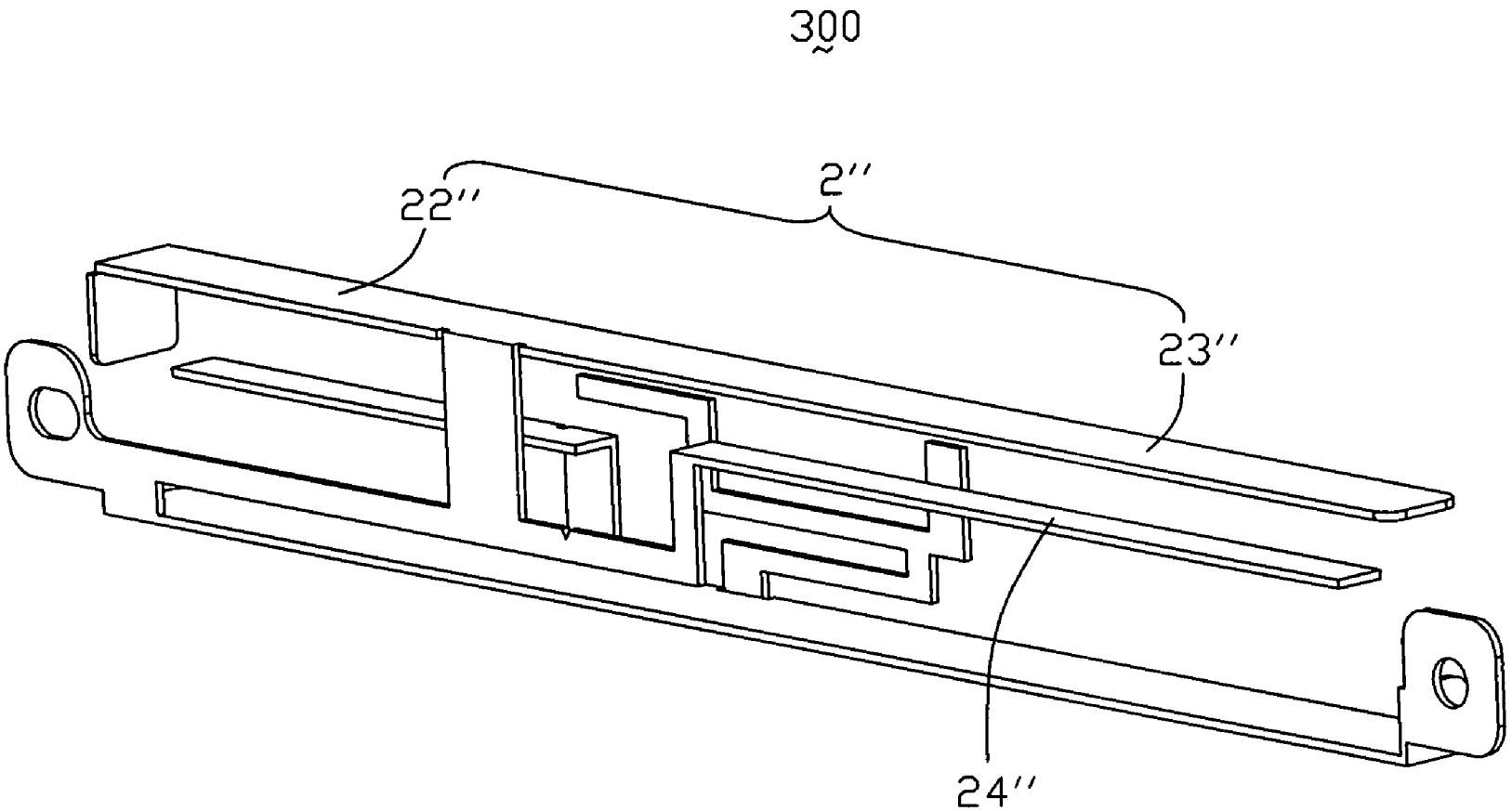
FIG. 6 is a view similar to FIG. 5, but from a different aspect.

Referring to FIG. 5 and FIG. 6, it's a complex antenna 300 in accordance with a third embodiment of the present invention. Basic structure of the complex antenna 300 is approximately same as that of the complex antenna 100. The complex antenna 300 also comprises a first antenna 1" and a second antenna 2". Description of the different between the complex antenna 300 and the complex antenna 100 is as follows.

The first antenna 1" of the complex antenna 300 comprises a Z-shaped first radiating element 12". The second antenna 2" of the complex 300 is same as the second antenna 2 of the complex antenna 100. The complex antenna 300 comprises an L-shaped coupling radiating element 7" extending from a side of the grounding element spaced apart a certain distance to the first antenna 1". A length of the coupling radiating element 7" is about equal to that of the fourth radiating element 23". So, the fifth radiating element 24" can widen the high frequency band of WWAN.

Figure 7:
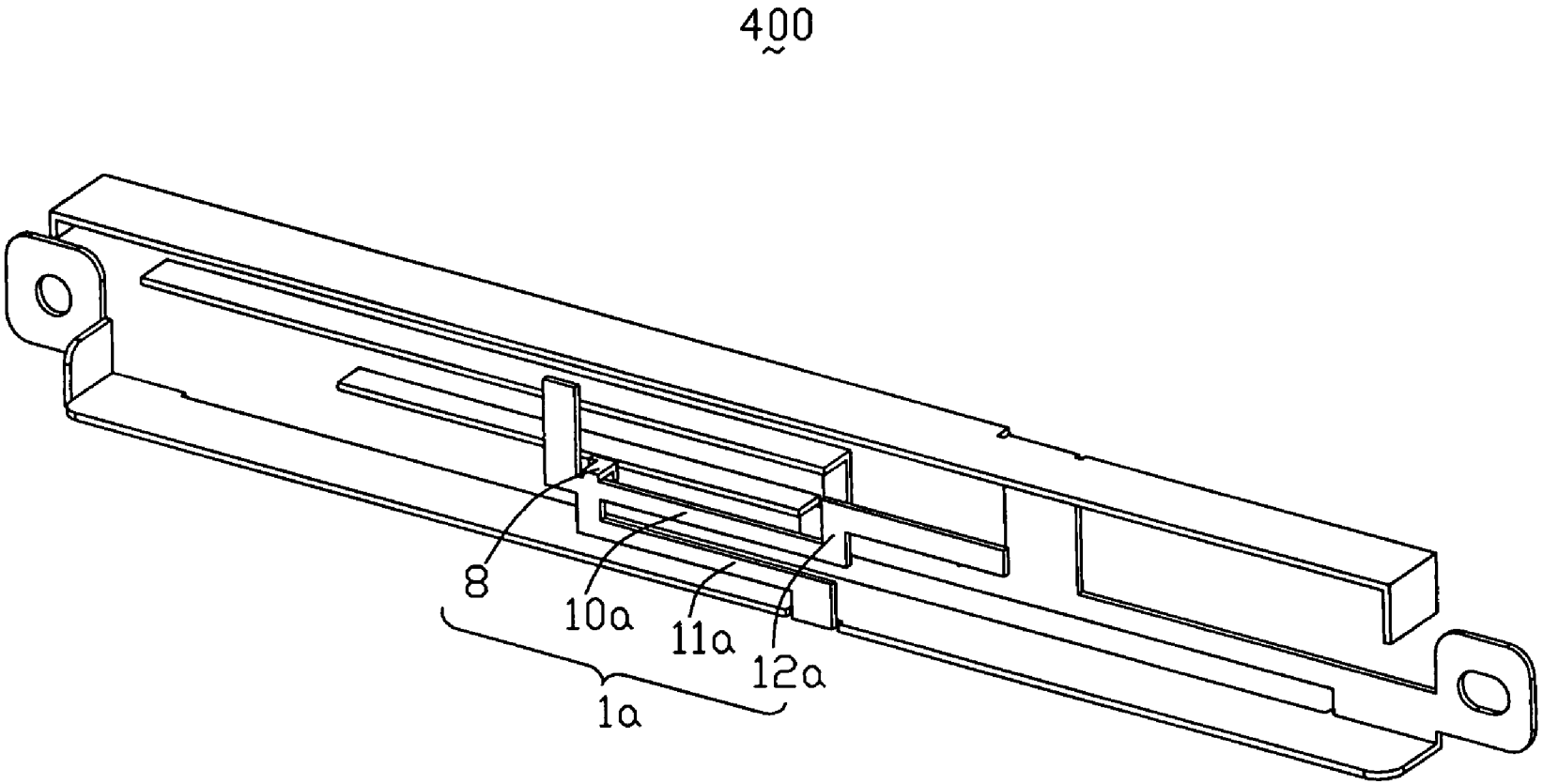
FIG. 7 is a perspective view of a complex antenna in accordance with a fourth embodiment of the present invention.
Figure 8:
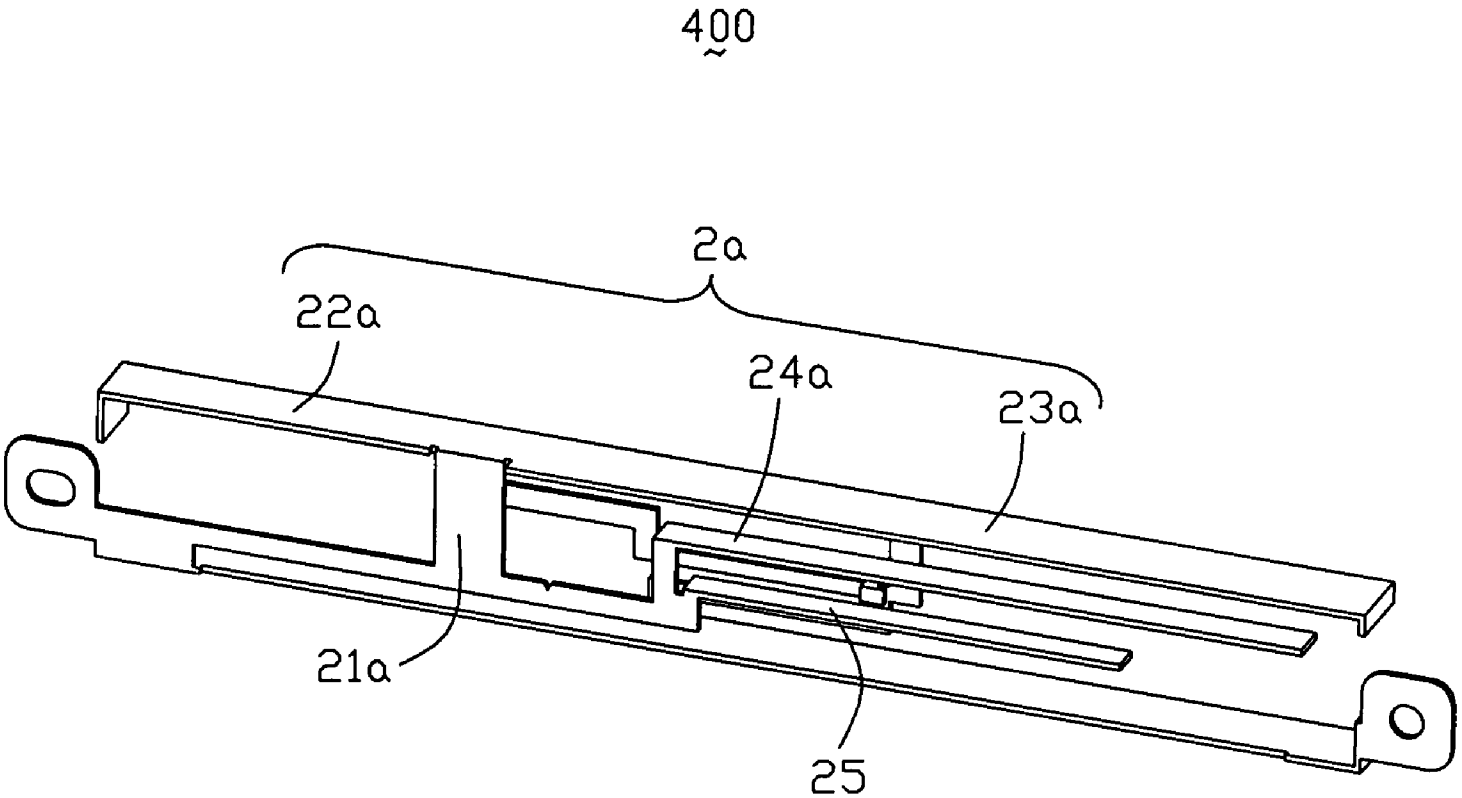
FIG. 8 is a view similar to FIG. 7, but from a different aspect.

Referring to FIG. 7 and FIG. 8, it's a complex antenna 400 in accordance with a fourth embodiment of the present invention. Basic structure of the complex antenna 400 is approximately same as that of the complex antenna 100. The complex antenna 400 also comprises a first antenna 1*a* and a second antenna 2*a*. Description of the different between the complex antenna 300 and the complex antenna 100 is as follows.

The first antenna la of the complex antenna 400 comprises a Z-shaped first radiating element 12*a*. An L-shaped feeding cap 8 extends from a joint of a radiating body 10*a* and a connecting element 11*a*. A feeding line comprises an inner conductor electrically connecting to the feeding cap 8. The second antenna 2*a* of the complex 400 adds a sixth radiating element 25 comparing with the second antenna 2 of the complex antenna 100. The sixth radiating element 25 extends from a corner of a fifth radiating element 24*a* and locates in underside of the fifth radiating element 24*a*. A length of the sixth radiating element 25 is about equal to that of the third radiating element 22*a* of the second antenna 2*a*. So, the sixth radiating element 25 can widen the high frequency band of WWAN. The third radiating element 22*a* locates in a side of the second connecting element 21*a* and the fourth radiating element 23*a*, the fifth radiating element 24*a*, and the sixth radiating element 25 locate in the other side of the second connecting element 21*a*.

While the foregoing description includes details which will enable those skilled in the art to practice the invention, it should be recognized that the description is illustrative in nature and that many modifications and variations thereof will be apparent to those skilled in the art having the benefit of these teachings. It is accordingly intended that the invention herein be defined solely by the claims appended hereto and that the claims be interpreted as broadly as permitted by the prior art.

What is claimed is:

1. A complex antenna comprising:

a grounding element with two longitudinal sides;

a first antenna, operating in a first wireless network, comprising a first radiating body spaced apart from the grounding element and a first connecting element connecting the first radiating body and the grounding element;

a second antenna, operating in a second wireless network, comprising a second body spaced apart from the grounding element and a second connecting element connecting the second radiating body and the grounding element; wherein the first antenna extends from an edge of the grounding element, the first radiating body comprises a first radiating element and a second radiating element; the second antenna extends from opposite the other edge of the grounding element, the second radiating body comprises a third radiating element extending from a terminal of the connecting element, a fourth radiating element, and a fifth radiating element extending from a middle portion of the connecting element.

2. The complex antenna as claimed in claim 1, wherein said fifth radiating element is a Z-shaped.

3. The complex antenna as claimed in claim 1, wherein said second radiating body comprises a sixth radiating element extending from the middle portion of the second connecting element.

4. The complex antenna as claimed in claim 1, wherein said complex antenna comprises an L-shaped coupling radiating element extending from a side of the grounding element and capable of widening frequency band of the second antenna.

5. The complex antenna as claimed in claim 1, wherein said second antenna comprises a feeding line comprising an inner conductor electrically connecting to the fifth radiating element.

6. The complex antenna as claimed in claim 1, wherein said second connecting element is a Z-shaped structure and comprises a first part extending upwardly from the side of the grounding element, a second part spaced apart from the first part, and a third part connecting the first part and the second part.

7. The complex antenna as claimed in claim 6, wherein said third part of the second connecting element is an inverted Z-shaped structure.

8. The complex antenna as claimed in claim 6, wherein said second antenna comprises a feeding line having an inner conductor electrically connecting to the third part of the second connecting element.

9. The complex antenna as claimed in claim 1, wherein said first antenna operates in WLAN; the first radiating element operates in 2.4 GHz frequency band and the second radiating element operates in 5 GHz frequency band.

10. The complex antenna as claimed in claim 1, wherein said second antenna operates in WWAN; the third radiating element operates in 1800 MHz and the fourth radiating element operating in 900 MHz.

11. A complex antenna comprising:

a grounding element;

a first antenna, comprising a first radiating body spaced apart from the grounding element and a first connecting element connecting the first radiating body and the grounding element;

a second antenna, comprising a second body spaced apart from the grounding element and a second connecting element connecting the second radiating body and the grounding element; wherein the second radiating body comprises four radiating elements; one radiating element locates at a side of the second connecting element and other three radiating elements locate the other side of the second connecting element.

12. The complex antenna as claimed in claim 11, wherein the first radiating body operates in WLAN and comprises a first radiating element operating in lower frequency band and a second radiating element operating in higher frequency band.

13. The complex antenna as claimed in claim 11, wherein the complex antenna comprises a first coupling radiating element extending from a side of the grounding element and capable of widening frequency band of the second antenna.

14. The complex antenna as claimed in claim 11, wherein the second radiating body comprises a third and fourth radiating elements extending from a terminal of the second connecting element, and a fifth and sixth radiating elements extending from a middle portion of the second connecting element; a terminal of the third radiating element locates at a side of the second connecting element and the fourth, fifth, sixth radiating elements locate at the other side of the second connecting element.

15. The complex antenna as claimed in claim 14, wherein each of the fifth and sixth radiating elements shows a Z-shaped structure.

16. The complex antenna as claimed in claim 14, wherein the second antenna comprises a feeding line comprising an inner conductor electrically connecting to the fifth radiating element.

17. The complex antenna as claimed in claim 11, wherein said two installing elements extend respectively from two terminals along longitudinal direction of the grounding element; all of the first antenna and the second antenna locate between the two installing elements.

18. The complex antenna as claimed in claim 17, wherein the grounding element has a top surface and a bottom surface; all of the first antenna, the second antenna, and the installing elements locate upside of the top surface of the grounding element.

19. A complex antenna comprising:

a grounding element (3) lying in a first horizontal plane and extending along a longitudinal direction with opposite first and second longitudinal edges parallel to each other;

a first connection section (21) lying in a first vertical plane extending from the first edge and having thereof a portion essentially along said longitudinal direction;

a first radiating element (22) lying a second horizontal plane parallel to said first horizontal plane and extending along said longitudinal direction with a length similar to that of said grounding element;

a second radiating element (24) extending from an end of said first connection section, and including a vertical part coplanar with the connection section and a horizontal part lying in a third horizontal plane between said first horizontal plane and said second horizontal plane in a parallel relation; and a second connection section (11) lying in a second vertical plane parallel to said first vertical plane and having a portion extending along said longitudinal direction;

a third radiating element (12) extending from an end of the second connection section in a coplanar manner.

20. The complex antenna as claimed in claim 19, further including either a fourth radiating element coplanar with the first radiating element, or a fifth radiating element coplanar with the third radiating element.

* * * * *